US008810118B2

(12) United States Patent
Sakayanagi

(10) Patent No.: US 8,810,118 B2
(45) Date of Patent: Aug. 19, 2014

(54) SPARK PLUG

(71) Applicant: NGK Spark Plug Co., Ltd., Nagoya (JP)

(72) Inventor: Nobuaki Sakayanagi, Toyohashi (JP)

(73) Assignee: NGK Spark Plug Co., Ltd., Nagoya (JP)

( * ) Notice: Subject to any disclaimer, the term of this patent is extended or adjusted under 35 U.S.C. 154(b) by 0 days.

(21) Appl. No.: 13/888,467

(22) Filed: May 7, 2013

(65) Prior Publication Data

US 2013/0293087 A1 Nov. 7, 2013

(30) Foreign Application Priority Data

May 7, 2012 (JP) ..... 2012-105623
Mar. 15, 2013 (JP) ..... 2013-052601

(51) Int. Cl.
*H01T 13/20* (2006.01)

(52) U.S. Cl.
USPC ..... 313/141; 313/118

(58) Field of Classification Search
CPC ..... H01T 13/39; H01T 13/32; H01T 13/20; H01T 21/02
USPC ..... 313/141, 118, 142; 445/7
See application file for complete search history.

(56) References Cited

U.S. PATENT DOCUMENTS

| | | | | |
|---|---|---|---|---|
| 6,750,597 | B1 | 6/2004 | Sakura | |
| 8,264,131 | B2 | 9/2012 | Sakayanagi et al. | |
| 8,427,038 | B2 * | 4/2013 | Taido et al. | 313/141 |
| 2012/0025691 | A1 | 2/2012 | Sakayanagi et al. | |

FOREIGN PATENT DOCUMENTS

| | | | |
|---|---|---|---|
| JP | 2001-68250 | A | 3/2001 |
| JP | 2003-123937 | A | 4/2003 |
| JP | 2011-154810 | A | 8/2011 |
| WO | WO 2010087076 | A1 * | 8/2010 |

* cited by examiner

*Primary Examiner* — Nimeshkumar Patel
*Assistant Examiner* — Glenn Zimmerman
(74) *Attorney, Agent, or Firm* — Leason Ellis LLP.

(57) ABSTRACT

A spark plug includes a tubular insulator, a center electrode, a tubular metal shell, a ground electrode, and a pillar body tip. The tubular insulator has an axial hole penetrating in the direction of an axis. The pillar body tip includes one end face that is welded to the ground electrode and another end face that forms a gap with a front end portion of the center electrode. The ground electrode includes a part where the tip is to be welded. The surface forms a clearance with a part including a constituent material of the tip. The ground electrode includes a surface where a plating layer is disposed. The plating layer covers a surface excluding a formation part of the clearance. The clearance has a size A that is equal to or more than 0.01 mm and equal to or less than 0.5 mm.

6 Claims, 6 Drawing Sheets

SPARK PLUG

CROSS-REFERENCE TO RELATED APPLICATION

This application claims the benefit of Japanese Patent Applications No. 2012-105623 filed May 7, 2012 and No. 2013-052601, filed Mar. 15, 2013, all of which are hereby incorporated by reference in their entirety.

FIELD OF THE INVENTION

This disclosure relates to a spark plug for use in an internal combustion engine or the like.

A spark plug for use in an internal combustion engine or the like includes, for example, an insulator, a center electrode, a tubular metal shell, and a rod-shaped ground electrode. The insulator has an axial hole extending in the direction of the axis. The center electrode is disposed inserted into the axial hole. The tubular metal shell is disposed at an outer circumference of the insulator. The ground electrode is secured to the metal shell. Additionally, a gap is formed between a front end portion of the ground electrode and a front end portion of the center electrode. Applying a voltage to the gap generates spark discharge. Nowadays, to improve wear resistance from spark discharge, the following method is proposed. A tip made of metal such as a noble metal alloy, which is excellent in durability, is welded to the front end portion of the ground electrode. This forms the gap between the tip and the center electrode. Generally, the tip is welded to the ground electrode with a fusion portion formed by melting the ground electrode and the tip, which are formed by laser welding, resistance welding, or the like.

To improve durability (oxidation resistance) in the ground electrode, a plating layer may be disposed on the surface of the ground electrode. The plating layer is made of metal that contains a material such as zinc and nickel as a main constituent. When sealing the tip to the ground electrode with this plating layer on its surface, to improve sealing strength of the tip to the ground electrode, the following method is known. The front end portion of the ground electrode is constituted without being covered by the plating layer. Then, the tip is welded to the front end portion of the ground electrode not covered with the plating layer. Here, as a method where the front end portion of the ground electrode is not covered with the plating layer, the following methods are provided. Masking is performed on the front end portion of the ground electrode, and then plating is performed on the ground electrode. The plating layer is once disposed on the entire surface region of the ground electrode, and the plating layer, which covers the front end portion of the ground electrode, is removed by a method such as soaking the front end portion of the ground electrode into an acid stripping solution (for example, see JP 2001-68250 A).

SUMMARY OF THE INVENTION

A spark plug includes a tubular insulator, a center electrode, a tubular metal shell, a ground electrode, and a pillar body tip. The tubular insulator has an axial hole penetrating in a direction of an axis. The center electrode is inserted into a tip end side of the axial hole. The tubular metal shell is disposed at an outer circumference of the insulator. The ground electrode is disposed at a front end portion of the metal shell. The pillar body tip includes one end face and another end face. The one end face is welded to the ground electrode. The other end face forms a gap with a front end portion of the center electrode. The ground electrode includes a part where the tip is to be welded. The surface forms a clearance with a part including a constituent material of the tip. The ground electrode includes a surface where a plating layer is disposed. The plating layer covers a surface excluding a formation part of the clearance in the surface of the ground electrode. The clearance has a size A that is equal to or more than 0.01 mm and equal to or less than 0.5 mm.

BRIEF DESCRIPTION OF THE DRAWINGS

These and other features and advantages of the present invention will become more readily appreciated when considered in connection with the following detailed description and appended drawings, wherein like designations denote like elements in the various views, and wherein.

DETAILED DESCRIPTION OF THE INVENTION

Figure 1:
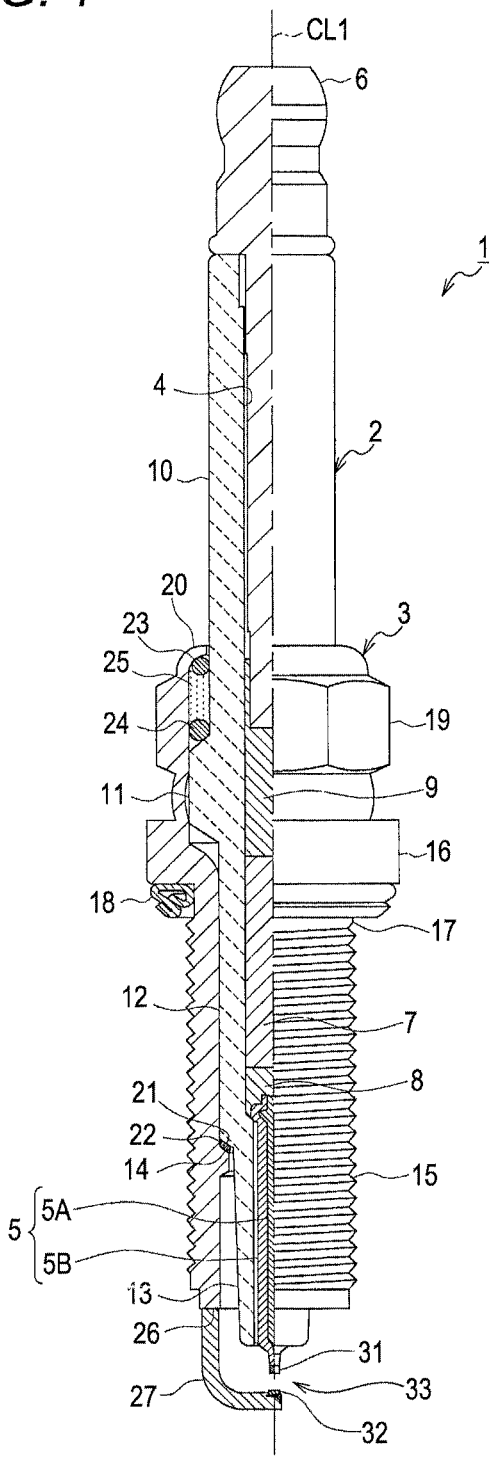
FIG. 1 is a partially sectioned front view showing the configuration of a spark plug.

In the following detailed description, for purpose of explanation, numerous specific details are set forth in order to provide a thorough understanding of the disclosed embodiments. It will be apparent, however, that one or more embodiments may be practiced without these specific details. In other instances, well-known structures and devices are schematically shown in order to simplify the drawing.

However, with the above-described methods, not only a part of the ground electrode where the tip is to be welded but also a comparatively wide range of the ground electrode is not covered with the plating layer and exposed to the outside. Accordingly, there may be a possibility that an enhancement effect in the durability of the ground electrode due to disposition of the plating layer is not successfully obtained.

In contrast to this, the following method is considered. The tip is welded to the ground electrode by laser welding or the like in a state where the plating layer is interposed between the ground electrode and the tip while the plating layer is disposed on the entire surface region of the ground electrode. According to this method, good durability of the ground electrode is ensured, and removal of the plating layer or a similar process is not required. Thus, it is considered that a reduction in production cost is achieved.

However, in this case, the plating layer contacts a fusion portion, which is formed by melting the tip and the ground electrode (that is, the part including a constituent material of the tip). Then, in this state, in view of the difference in thermal expansion coefficient between the tip, etc. and the plating layer, due to thermal expansion from heating, the plating layer easily contacts (runs up on) a surface (a discharge surface) disposed at the gap side among a member such as a tip. Furthermore, if the plating layer repeatedly contacts the discharge surface such as a tip accompanied by repetitive thermal cycling, peeling may occur in a part that possibly contacts the discharge surface in the plating layer. Here, if the plating layer peels, the peeled plating layer enters the gap, and therefore the spark discharge may not be generated in the gap (that is, misfire occurs).

This disclosure has been made to solve the above-mentioned problems, and an object thereof is to provide good durability of the ground electrode and a spark plug that reliably prevents the peeling of the plating layer accompanied by contact of a member such as a tip to the discharge surface.

Configurations suitable for achieving the above object will next be described in itemized form. If needed, actions and effects peculiar to the configurations will be described additionally.

Configuration 1: a spark plug of the present configuration includes:

a tubular insulator having an axial hole penetrating in a direction of an axis;

a center electrode inserted into a tip end side of the axial hole;

a tubular metal shell disposed at an outer circumference of the insulator;

a ground electrode disposed at a front end portion of the metal shell; and a pillar body tip that includes one end face and another end face, the one end face being welded to the ground electrode, the other end face forming a gap with a front end portion of the center electrode, wherein the ground electrode includes a part where the tip is to be welded, a clearance formed between a plating layer and a part including a constituent material of the tip;

the ground electrode includes a surface where the plating layer is disposed, the plating layer covering the surface excluding a formation part of the clearance in the surface of the ground electrode; and the clearance has a size A that is equal to or more than 0.01 mm and equal to or less than 0.5 mm.

Note that "covering a surface excluding a formation part of the clearance in the surface of the ground electrode" does not only include a case where the plating layer covers the entire region other than the formation part of the clearance in the surface of the ground electrode but includes a case where the plating layer covers almost the entire region other than the formation part of the clearance. That is, a case where a part other than the formation part of the clearance in the surface of the ground electrode is not covered with the plating layer is also included.

Additionally, "a part including a constituent material of the tip" refers to the tip itself or the fusion portion, which is formed by melting the tip and the ground electrode. For example, when the fusion portion is formed at the entire outer circumference region of the side faces of the tip, the clearance is formed between the fusion portion and the plating layer. When the fusion portion is formed at a part of an outer circumference of the side faces of the tip, the clearance is formed between the fusion portion and the plating layer, and between the surface where the fusion portion is not formed in the outer circumference in the side faces of the tip and the plating layer. When the fusion portion is hardly formed, for example, when the tip is welded to the ground electrode by resistance welding, the clearance is formed between the side face of the tip and the plating layer.

According to the configuration 1, the clearance is formed between the part, which includes a constituent material of the tip (the tip and the fusion portion), and the plating layer. A size A of the clearance is set to be equal to or more than 0.01 mm. Therefore, due to thermal expansion from heating, the contact (running up on) made with the plating layer to a surface positioned at the center electrode side among the tip and the fusion portion can be efficiently reduced. As a result, peeling of the plating layer accompanied by contact to the other end face of the tip, etc. can be reliably prevented. Eventually, misfire or the like accompanied by the peeling of the plating layer can be reduced.

Furthermore, according to the configuration 1, the surface of the ground electrode excluding the formation part of the clearance is covered with the plating layer, and the size A of the clearance is equal to or less than 0.5 mm. Accordingly, penetration of oxygen or the like between the plating layer and the ground electrode can be reduced. Thus, contact of oxygen or the like to the ground electrode can be reliably prevented. As a result, excellent durability of the ground electrode is achieved.

Configuration 2: a spark plug of the present configuration is characterized in that, in the configuration 1, the plating layer has a distance B from a surface of a part closest to the tip to the other end face of the tip along a central axis of the tip. The distance B is equal to or less than 0.2 mm.

According to the configuration 2, the distance B is equal to or less than 0.2 mm, and the other end face (the discharge surface) of the tip and the surface of the plating layer are constituted to form approximately a flat surface. Accordingly, spark discharge easily occurs not only at the other end face of the tip, but also at the surface of the plating layer with the center electrode. This further reliably prevents local wear of the tip only. Additionally, this reduces a projection of the tip from the ground electrode, thus further reliably preventing the overheating of the tip. From these results, wear resistance against spark discharge can be remarkably improved.

When the distance B is small, since the plating layer is close to the other end face of the tip, contact (running up on) of the plating layer to the surface positioned at the center electrode side among the tip and the fusion portion due to thermal expansion from heating is more likely to occur. The peeling of the plating layer accompanied by contact to the other end face of the tip, etc. is further apprehended. However, adoption of the configuration 1 further reliably prevents contact of the plating layer to the other end face of the tip, etc. and eventually, peeling of the plating layer accompanied by the contact even if the distance B is equal to or less than 0.2 mm as the configuration 2. In other words, the configuration 1 is considerably effective for use of a spark plug where the distance B is equal to or less than 0.2 mm and contact of the plating layer to the other end face of the tip, etc. especially tends to occur.

Configuration 3: a spark plug of the present configuration is characterized in that, in the configuration 1 or 2, the clearance has the size A that is equal to or less than 0.2 mm.

According to the configuration 3, the clearance has the size A that is equal to or less than 0.2 mm. Accordingly, contact of oxygen or the like to the ground electrode is further reliably prevented, thus durability of the ground electrode can be further improved.

Configuration 4: a spark plug of the present configuration is characterized in that, in any one of the configurations 1 to 3, the clearance has the size A that is equal to or less than 0.1 mm.

According to the configuration 4, the clearance has the size A that is equal to or less than 0.1 mm. Accordingly, contact of oxygen or the like to the ground electrode is further reliably prevented, thus durability of the ground electrode can be further improved.

Configuration 5: a spark plug of the present configuration is characterized in that, in any of the configurations 1 to 4, the plating layer includes a groove portion disposed in a range of up to 0.4 mm from the inner circumference end of the plating layer to a direction separated from the tip along a perpendicular direction to a central axis of the tip. The inner circumference end forms the clearance with a part that includes a constituent material of the tip in the plating layer.

According to the configuration 5, the plating layer includes a groove portion disposed in a range of up to 0.4 mm from the inner circumference end of the plating layer to a direction separated from the tip. In other words, in the plating layer, a groove portion is formed at a part that easily contacts (runs up on) the other end face of the tip, etc. due to thermal expansion from heating. Accordingly, during heating, the plating layer can expand thermally to the groove portion side. Thus, the thermal expansion of the plating layer to the tip side can be reduced. This significantly and efficiently reduces the contact of the plating layer to the other end face of the tip, etc. from thermal expansion. Eventually, the efficiency for preventing peeling of the plating layer is dramatically enhanced.

Configuration 6: a spark plug of the present configuration is characterized in that, in any of the configurations 1 to 5, the plating layer has a part positioned at the clearance side that is constituted such that a distance along a central axis of the tip from a surface of the plating layer to the other end face of the tip gradually increases as the plating layer approaches the tip side.

According to the configuration 6, when the ground electrode is at a high temperature and thermal expansion occurs, the plating layer is further less likely to contact (run up on) the other end face of the tip, etc. Accordingly, the peeling of the plating layer is further reliably prevented.

One embodiment will next be described with reference to the drawings. FIG. 1 is a partially sectioned front view showing a spark plug 1. Note that in the description of FIG. 1, a description will be given of a direction in which an axis CL1 of the spark plug 1 is a vertical direction in the drawing. Moreover, the lower side is the tip end side of the spark plug 1, and the upper side is the rear end side.

The spark plug 1 includes an insulator 2 as a tubular insulator, a tubular metal shell 3 which holds the insulator 2 therein, etc.

The insulator 2 is formed from alumina or the like by firing, as well known in the art. The insulator 2, as viewed externally, includes a rear trunk portion 10 formed on the rear end side; a large-diameter portion 11, which is located frontward of the rear trunk portion 10 and projects radially outward; an intermediate trunk portion 12, which is located frontward of the large-diameter portion 11 and is smaller in diameter than the large-diameter portion 11; and a leg portion 13, which is located frontward of the intermediate trunk portion 12 and is smaller in diameter than the intermediate trunk portion 12. The large-diameter portion 11, the intermediate trunk portion 12, and the greater portion of the leg portion 13 of the insulator 2 are accommodated within the metal shell 3. In addition, a tapered step portion 14 is formed at a coupling portion of the intermediate trunk portion 12 and the leg portion 13. The insulator 2 is seated on the metal shell 3 at the step portion 14.

Further, the insulator 2 has an axial hole 4 penetrating therethrough along the axis CL1. A center electrode 5 is inserted into a front end side of the axial hole 4. The center electrode 5 is composed of an inner layer 5A formed of metal, etc. excellent in thermal conductivity (for example, copper, copper alloy, and pure nickel (Ni)) and an outer layer 5B formed of an alloy which contains Ni as a main constituent. The center electrode 5 has a rodlike shape (circular columnar shape) as a whole, and has a flat front end surface. The front end surface of the center electrode 5 projects from the front end portion of the insulator 2. A circular center electrode side tip 31 formed of a certain metal (e.g., iridium (Ir), platinum (Pt), rhodium (Rh), ruthenium (Ru), rhenium (Re), tungsten (W), palladium (Pd), or an alloy containing at least one of these materials as a main constituent, or a similar material) is provided at the front end portion of the center electrode 5.

Also, a terminal electrode 6 is fixedly inserted into a rear end portion of the axial hole 4 and projects from the rear end of the insulator 2.

A circular columnar resistor 7 is disposed within the axial hole 4 between the center electrode 5 and the terminal electrode 6. Opposite end portions of the resistor 7 are electrically connected to the center electrode 5 and the terminal electrode 6, respectively, via electrically conductive glass seal layers 8 and 9.

The metal shell 3 is formed into a tubular shape from a low-carbon steel or a like metal. The metal shell 3 has, on its outer circumferential surface, a thread portion (external thread portion) 15 adapted to mount the spark plug 1 into a mounting hole of a combustion apparatus (e.g., an internal combustion engine or a fuel cell reformer). Also, the metal shell 3 has a flange seat portion 16 located rearward of the thread portion 15. A ring-like gasket 18 is fitted to a thread root 17 at the rear end of the thread portion 15. Further, the metal shell 3 has, near the rear end thereof, a tool engagement portion 19 having a hexagonal cross section and allowing a tool, such as a wrench, to be engaged therewith when the metal shell 3 is to be mounted to the combustion apparatus. Also, the metal shell 3 has a crimp portion 20 provided at a rear end portion thereof for retaining the insulator 2.

Also, a tapered step portion 21 is formed on the inner circumferential surface of the metal shell 3 so as to receive the insulator 2, which butts against the step portion 21. The insulator 2 is inserted frontward into the metal shell 3 from the rear end of the metal shell 3. In a state in which the step portion 14 of the insulator 2 butts against the step portion 21 of the metal shell 3, a rear-end opening portion of the metal shell 3 is crimped radially inward; i.e., the above-mentioned crimp portion 20 is formed, whereby the insulator 2 is fixed to the metal shell 3. An annular sheet packing 22 intervenes between both step portions 14 and 21. This retains gas tightness of a combustion chamber and prevents outward leakage of fuel gas which enters the clearance between the inner circumferential surface of the metal shell 3 and the leg portion 13 of the insulator 2, which is exposed to the combustion chamber.

Further, in order to ensure gas tightness, which is established by crimping, annular ring members 23 and 24 intervene between the metal shell 3 and the insulator 2 in a region near the rear end of the metal shell 3, and a space between the ring members 23 and 24 is filled with powder of talc 25. That is, the metal shell 3 holds the insulator 2 via the sheet packing 22, the ring members 23 and 24, and the talc 25.

Figure 2:
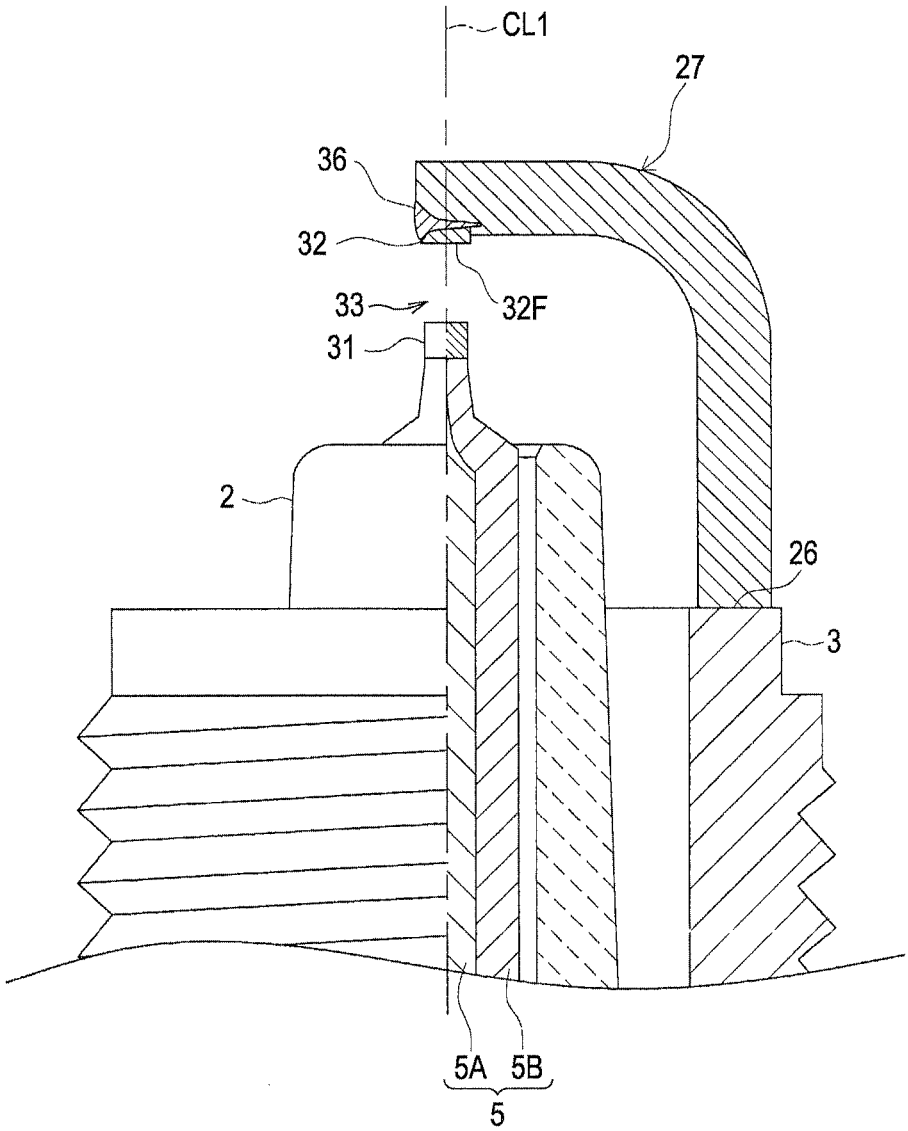
FIG. 2 is an enlarged, partially sectioned front view showing the configuration of a front end portion of the spark plug.

As shown in FIG. 2, a rod-shaped ground electrode 27 is welded to a front end portion 26 of the metal shell 3. The ground electrode 27 is bent at an approximately center thereof, and its distal end faces a front end portion of the center electrode 5 (the center electrode side tip 31). The ground electrode 27 is formed of an alloy whose main constituent is Ni (e.g., an alloy whose main constituent is Ni and contains at least any one of silicon, aluminum, and, rare-earth element).

Additionally, in the ground electrode 27, at a part facing the front end face of the center electrode 5 (the center electrode side tip 31), one end face of a disk-shaped ground electrode side tip 32 (corresponding to the "tip" in this disclosure) is welded. The ground electrode side tip 32 is constituted of a certain metal (e.g. Ir, Pt, Rh, Ru, Re, W, Pd, an alloy containing at least any one of these materials as a main constituent, etc.). In this embodiment, the ground electrode side tip (noble metal tip) 32 is assumed to be comparatively thin (e.g. equal to or less than 0.4 mm) to reduce production cost, whereas an area of the other end face (a discharge surface) 32F of the ground electrode side tip 32 is assumed to be comparatively large (e.g. equal to or more than 0.3 $mm^2$) to improve wear resistance.

A spark discharge gap 33 as a gap is formed between the other end face 32F of the ground electrode side tip 32 and the front end face of the center electrode 5 (the center electrode side tip 31), and spark discharge occurs at the spark discharge gap 33 in a direction along the axis CL1.

Figure 3:
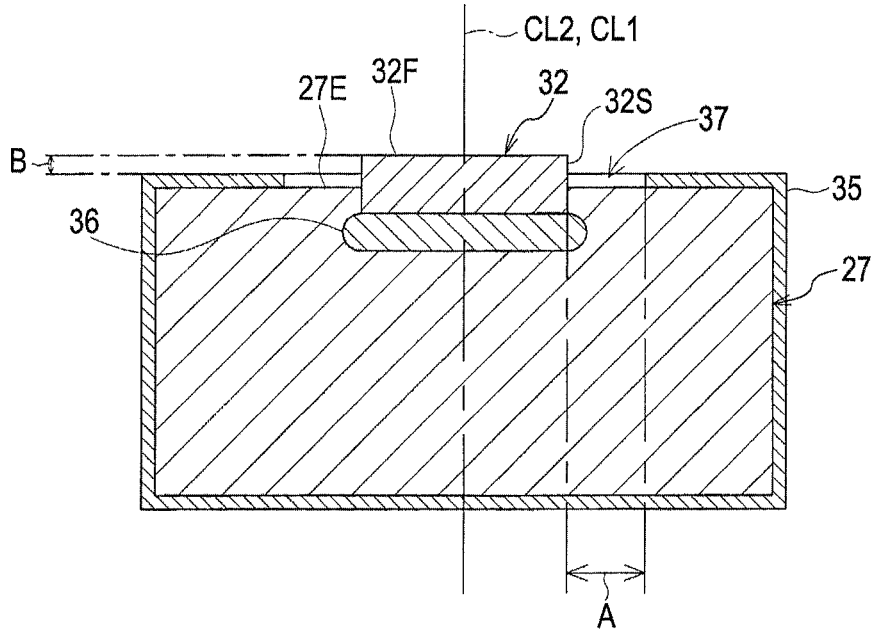
FIG. 3 is a sectional view showing a clearance, etc. formed between a plating layer and a ground electrode side tip.
Figure 4:
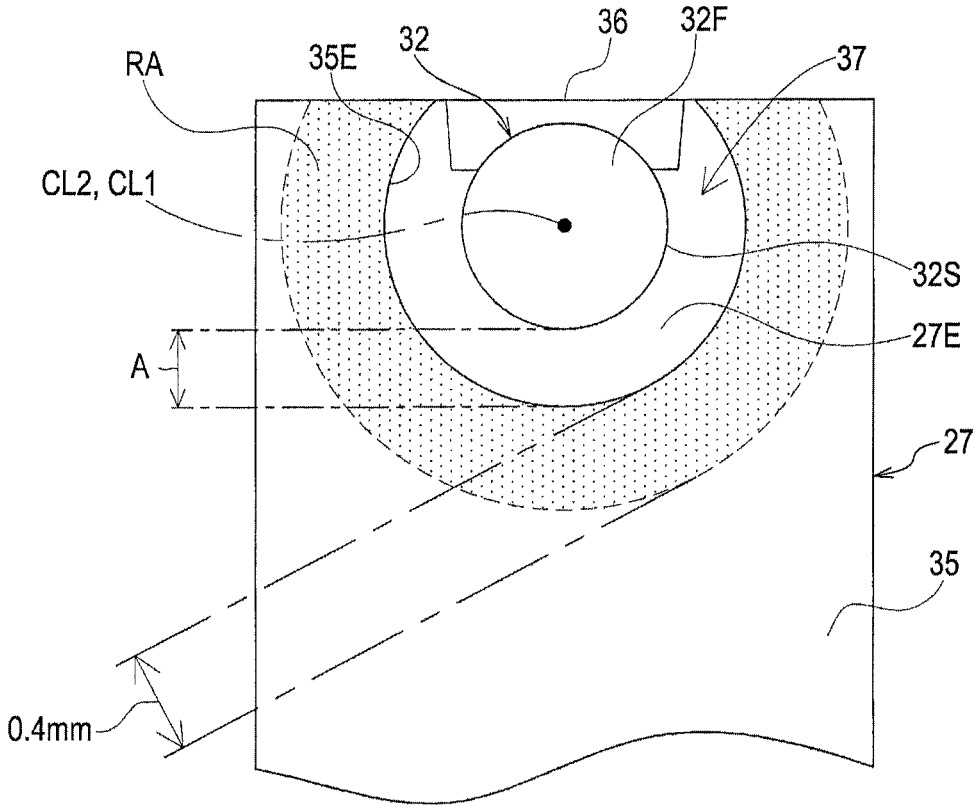
FIG. 4 is an enlarged top view showing a ground electrode and a ground electrode side tip, etc.

Additionally, as shown in FIG. 3 and FIG. 4 (note that in FIG. 3, the thickness of the plating layer 35 is depicted thicker than the actual thickness for convenience of illustration), the ground electrode 27 includes, on its surface, a base material exposed portion 27E where a base material of the ground electrode 27 is exposed. The part excluding the base material exposed portion 27E is covered with the plating layer 35 made of a thin metal wall (for example, the thickness is equal to or less than 10 μm) employing Ni as a main constituent. One end face of the ground electrode side tip 32 is welded to the base material exposed portion 27E.

Note that the base material exposed portion 27E can be formed by methods such as the following. A plating layer is disposed on the entire surface region of the ground electrode 27, and then a part of the plating layer is peeled. Alternatively, the plating layer is disposed after masking a part of the ground electrode 27.

Additionally, in this embodiment, the ground electrode side tip 32 is placed on the base material exposed portion 27E. Then, a laser beam (for example, fiber laser) is applied from the front end face side of the ground electrode 27 to the contact surfaces of the base material exposed portion 27E and the ground electrode side tip 32. Both the ground electrode 27 and the ground electrode side tip 32 are melted to form a fusion portion 36. Thus, the ground electrode side tip 32 is welded to the ground electrode 27.

Furthermore, in this embodiment, a clearance 37 is formed between a side face 32S of the ground electrode side tip 32 and the plating layer 35 on a surface where the ground electrode side tip 32 is welded in the ground electrode 27. The clearance 37 has a size A that is equal to or more than 0.01 mm and equal to or less than 0.5 mm (more preferably, equal to or less than 0.2 mm, and further preferably, equal to or less than 0.1 mm). That is, while the plating layer 35 is constituted so as not to contact the ground electrode side tip 32, in the surface of the ground electrode 27, the area of a part not covered with the plating layer 35 is constituted to be considerably small.

In addition, in the plating layer 35, a distance B, which is a distance from the surface of a part most close to the ground electrode side tip 32 to the other end face 32F of the ground electrode side tip 32, goes along a central axis CL2 of the ground electrode side tip 32. The distance B is assumed to be equal to or less than 0.2 mm. That is, the surface of the plating layer 35 and the other end face 32F are constituted to form approximately a flat surface without an excessive projection and sinking of the other end face 32F of the ground electrode side tip 32 relative to the plating layer 35.

Figure 5:
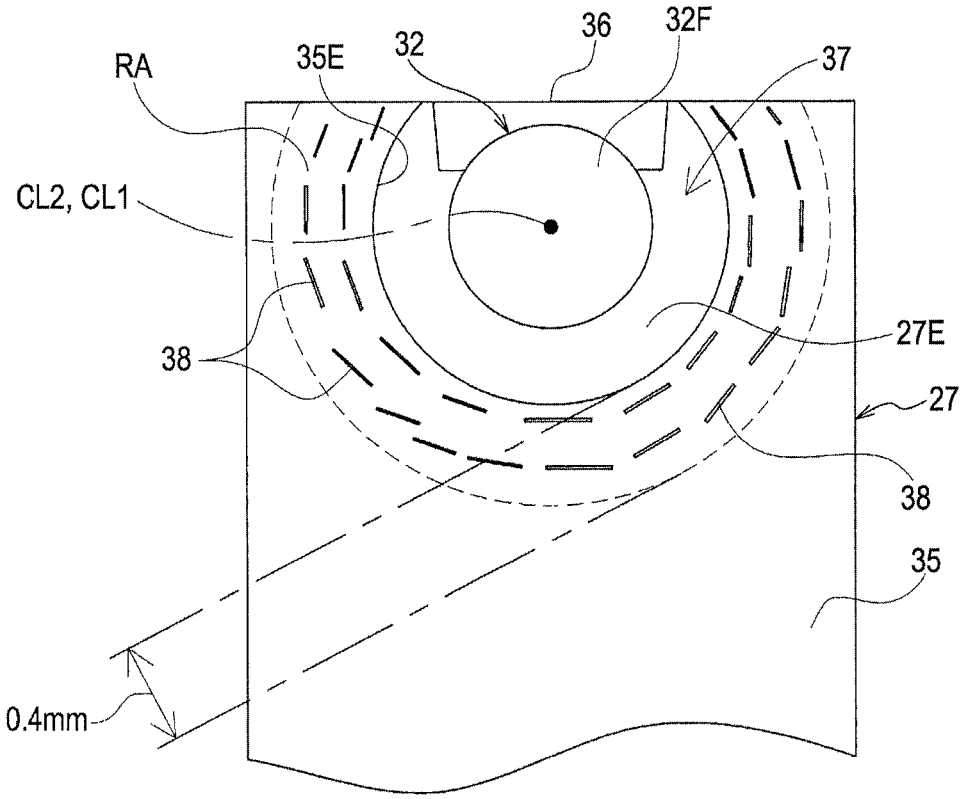
FIG. 5 is an enlarged top view showing a groove portion, etc.

Additionally, in this embodiment, the plating layer 35 includes a plurality of strip-like groove portions 38 extending along a circumferential direction of the ground electrode side tip 32 as shown in FIG. 5. The plurality of groove portions 38 is disposed in the plating layer 35 from an inner circumference end 35E, which forms the clearance 37 with the side face 32S of the ground electrode side tip 32, along the direction perpendicular to the central axis CL2 of the ground electrode side tip 32 to the direction separated from the ground electrode side tip 32 within a range RA of up to 0.4 mm (a part where a dot pattern is drawn in FIG. 4). In this embodiment, the width of the groove portion 38 is assumed to be equal to or more than 0.01 mm and equal to or less than 0.05 mm.

Note that the groove portion 38 is formed by rapidly heating and quenching the plating layer 35 and then rapidly expanding and shrinking the plating layer 35 during formation of the fusion portion 36. Since the plating layer 35 is comparatively thin as described above, the groove portion 38 passes through from the surface of the plating layer 35 to the surface of the ground electrode 27.

Figure 6:
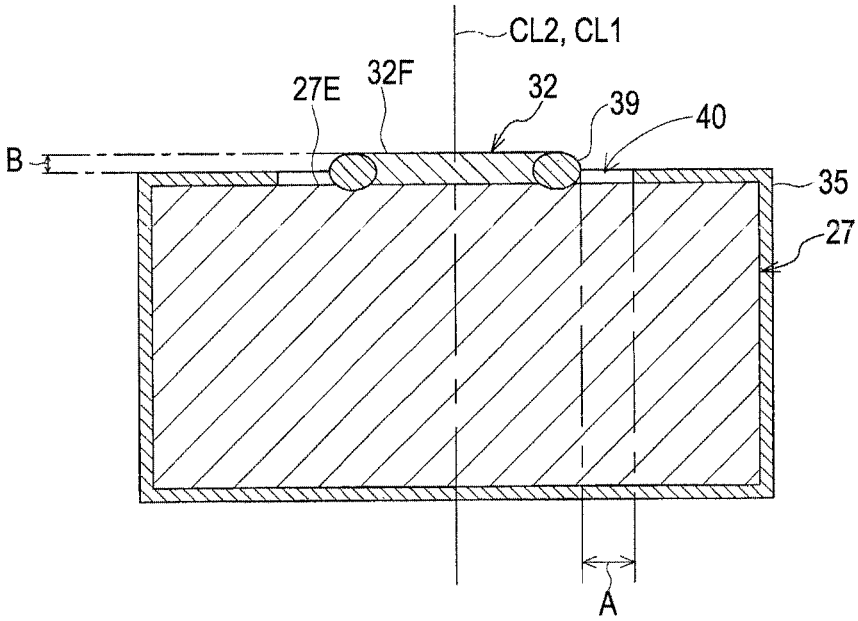
FIG. 6 is a sectional view showing a fusion portion, etc. formed at an outer circumference of a ground electrode side tip.
Figure 7:
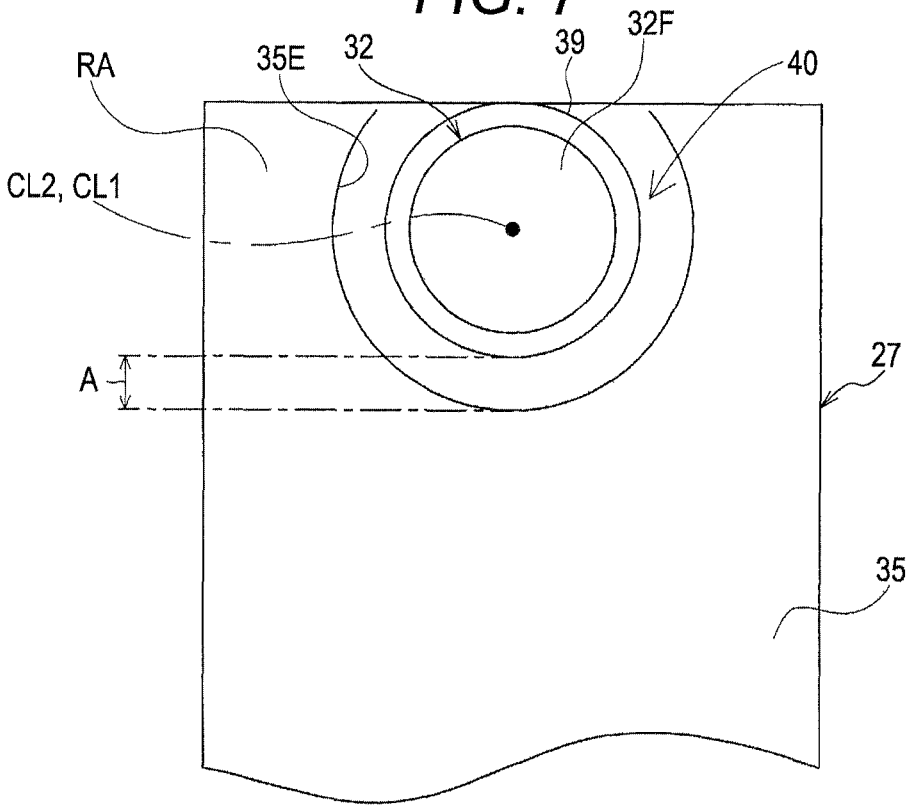
FIG. 7 is an enlarged top view showing a clearance, etc. formed between the fusion portion and the plating layer.

The above describes a case where the clearance 37 is formed between the side face of the ground electrode side tip 32 and the plating layer 35. In addition the clearance 37 is also formed between a part including a constituent material of the ground electrode side tip 32 and the plating layer 35. Therefore, for example, as shown in FIG. 6 and FIG. 7 (note that in FIG. 6, the thickness of the plating layer 35 is depicted thicker than the actual thickness for convenience of illustration), a fusion portion 39, which is formed by melting the ground electrode side tip 32 and the ground electrode 27, is formed across the entire circumferential direction of the outer circumference of the ground electrode side tip 32. In the case where the ground electrode side tip 32 is welded to the ground electrode 27, a clearance 40 is formed between the fusion portion 39 and the plating layer 35. The clearance 40 has a size A that is equal to or more than 0.01 mm and equal to or less than 0.5 mm (more preferably, equal to or less than 0.2 mm, and further preferably, equal to or less than 0.1 mm).

As described above, according to this embodiment, the clearance 37 or the clearance 40 is formed between the side face 32S of the ground electrode side tip 32 or between the fusion portion 39 and the plating layer 35. The size A of the clearances 37 and 40 is assumed to be equal to or more than 0.01 mm. Therefore, the plating layer 35 contacting (running up on) a surface (e.g. the other end face 32F) positioned at the center electrode 5 side among the ground electrode side tip 32 and the fusion portion 39 due to thermal expansion from heating can be efficiently reduced. As a result, peeling of the plating layer 35 accompanied by contact to the other end face 32F of the ground electrode side tip 32, etc. can be reliably prevented. Therefore, misfire or the like accompanied by the peeling of the plating layer 35 can be reduced.

Furthermore, the surfaces of the ground electrode 27 excluding the formation part of the clearances 37 and 40 (namely, the base material exposed portion 27E) are covered with the plating layer 35. Furthermore, the size A of the clearances 37 and 40 is assumed to be equal to or less than 0.5 mm. Accordingly, penetration of oxygen or the like between the plating layer 35 and the ground electrode 27 can be reduced. Thus, contact of oxygen or the like to the ground electrode 27 can be reliably prevented. As a result, excellent durability of the ground electrode 27 is achieved.

Like this embodiment, durability of the ground electrode 27 is further improved by setting the size A of the clearances 37 and 40 to equal to or less than 0.2 mm. Durability of the ground electrode 27 is remarkably improved by setting the size A of the clearances 37 and 40 to equal to or less than 0.1 mm.

Additionally, in this embodiment, the plurality of groove portions 38 is formed at the plating layer 35 in the range RA. In other words, in the plating layer 35, the groove portions 38 are formed at a part where the plating layer 35 easily contacts (runs up on) the other end face 32F of the ground electrode side tip 32, etc. due to thermal expansion from heating. Accordingly, during heating, the plating layer 35 can expand thermally to the groove portion 38 side. Thus, the thermal expansion of the plating layer 35 to the ground electrode side tip 32 side can be reduced. This significantly and efficiently reduces the contact of the plating layer 35 to the other end face 32F, etc. accompanied by thermal expansion. Eventually, the efficiency of prevention of the peeling of the plating layer 35 is dramatically enhanced.

Additionally, in this embodiment, the distance B is equal to or less than 0.2 mm, and the other end face 32F of the ground electrode side tip 32 and the surface of the plating layer 35 are constituted to form approximately a flat surface. Accordingly, spark discharge easily occurs not only at the other end face 32F of the ground electrode side tip 32, but also at the surface of the plating layer 35 between the other end face 32F and the center electrode 5 (the center electrode side tip 31). This further reliably prevents local wear of the ground electrode side tip 32 only. Additionally, reduction of a projection of the ground electrode side tip 32 from the ground electrode 27 further reliably prevents overheating of the ground electrode side tip 32. From these results, wear resistance against spark discharge can be remarkably improved.

Next, in order to confirm the action and effect achieved by the above-described embodiment, the plating layer was disposed on the surface of the ground electrode. A plurality of samples of the spark plugs where the sizes A of the clearances were variously changed were manufactured, and a benchtop thermal cycle test was performed on each sample. The overview of the benchtop thermal cycle test is as follows. The sample was heated with a burner for two minutes such that the temperature at the circumference of the ground electrode side tip becomes 800° C. under air atmosphere. Then, the samples were cooled slowly for one minute (two minutes heating and one-minute slow cooling were defined as one cycle and this cycle was repeated by 1000 cycles).

Then, after completion of 1000 cycle's, to confirm that peeling is unlikely to occur (anti-peeling performance) at the proximity of the ground electrode side tip in the plating layer, whether the plating layer contacts (runs up on) the other end face (the discharge surface) of the ground electrode side tip was confirmed. Here, in the sample where the plating layer contacts the other end face of the ground electrode side tip, the plating layer was considered likely to peel by repetitive thermal cycles. Therefore, the sample was evaluated as "poor". Meanwhile, the plating layer of the sample where the plating layer does not contact the other end face of the ground electrode side tip is unlikely to peel due to repetitive thermal cycles. This sample was regarded to have excellent anti-peeling performance, and therefore evaluated as "good".

Additionally, to evaluate durability (oxidation resistance) in the ground electrode, after completion of 1000 cycles, an image of a cross section including the central axis of the ground electrode side tip was taken with a metallographic microscope with 50 magnification. Then, based on the obtained images, in the side faces of the ground electrode, an oxide film (an oxide scale) formed on a surface where the ground electrode side tip was welded was identified, and the maximum value of the thickness of the oxide film was measured. Here, the sample with the maximum value of equal to or more than 0.2 mm was considered to have insufficient durability of the ground electrode, and therefore evaluated this sample as "poor". Meanwhile, the sample with the maximum value of less than 0.2 mm was regarded as one with excellent durability, and therefore evaluated this sample as "good".

The results of the above-described tests are listed in Table 1. Note that, in Table 1, the size A of the clearance of 0.00 mm means that the plating layer contacts the side face of the ground electrode side tip. A plating layer made of metal with the main constituent of Ni was formed for each sample, and the thickness of the plating layer was set to approximately 10 μm (the same applies to the tests described below). Furthermore, the distance B was set to 0.05 mm for each sample. Additionally, each sample was constituted so as not to form a fusion portion on the outer circumference of the side face of the ground electrode side tip. A clearance was formed between the side face of the ground electrode side tip and the plating layer of the sample where the size A of the clearance was set to more than 0.00 mm.

TABLE 1

DISTANCE B = 0.05 mm, HEATING TEMPERATURE = 800° C.

| SIZE A OF CLEARANCE (mm) | ANTI-PEELING PERFORMANCE OF PLATING LAYER | DURABILITY OF GROUND ELECTRODE |
|---|---|---|
| 0.00 | POOR | GOOD |
| 0.01 | GOOD | GOOD |
| 0.05 | GOOD | GOOD |
| 0.10 | GOOD | GOOD |
| 0.5 | GOOD | GOOD |
| 0.8 | GOOD | POOR |

As shown in Table 1, it was confirmed that in the sample where the size A of the clearance was 0.00 mm, the plating layer contacted the other end face of the ground electrode side tip, and the plating layer was likely to peel.

Furthermore, it was found that the sample where the size A of the clearance was larger than 0.5 mm was inferior in durability of the ground electrode. This probably occurred because of the following circumstance. By setting the size A of the clearance to more than 0.5 mm, oxygen or the like easily penetrated from the clearance formed between the plating layer and the ground electrode side tip to between the ground electrode and the plating layer.

In contrast to this, it was found that the sample where the size A of the clearance was equal to or more than 0.01 mm and equal to or less than 0.5 mm was excellent in both anti-peeling performance of the plating layer and durability of the ground electrode.

From the above-described test results, in terms of achieving excellent durability in the ground electrode while preventing peeling of the plating layer, the following is preferred. A clearance is formed between a part including a constituent material of the ground electrode side tip and the plating layer on the surface where the ground electrode side tip is welded in the ground electrode. The size A of the clearance is set to be equal to or more than 0.01 mm and equal to or less than 0.5 mm.

Next, heating temperature was changed to 900° C. for the sample of the spark plug where the size A of the clearance was 0.2 mm and the sample where the size A of the clearance was 0.3 mm. The above-described benchtop thermal cycle test was performed under the condition where the oxide film is further likely to be formed. Then, after completion of 1000 cycles, with the method similar to the above-described method, anti-peeling performance of the plating layer and durability of the ground electrode were evaluated.

The results of the tests are listed in Table 2. The distance B was set to 0.05 mm for each sample, and a clearance was formed between the side face of the ground electrode side tip and the plating layer.

TABLE 2

DISTANCE B = 0.05 mm, HEATING TEMPERATURE = 900° C.

| SIZE A OF CLEARANCE (mm) | ANTI-PEELING PERFORMANCE OF PLATING LAYER | DURABILITY OF GROUND ELECTRODE |
|---|---|---|
| 0.2 | GOOD | GOOD |
| 0.3 | GOOD | POOR |

As shown in Table 2, it was found that the sample with the size A of clearance equal to or less than 0.2 mm was able to ensure excellent durability of the ground electrode although the sample was under a strict condition where an oxide film was likely to be formed. This is probably because penetration of oxygen or the like between the plating layer and the ground electrode was efficiently reduced by setting the size A of the clearance equal to or less than 0.2 mm.

From the above-described test results, to further improve durability of the ground electrode, it is further preferred that the size A of the clearance be equal to or less than 0.2 mm.

Next, heating temperature was changed to 950° C. for the sample of the spark plug where the size A of the clearance is 0.1 mm and the sample where the size A of the clearance is 0.2 mm. The above-described benchtop thermal cycle test was performed under the condition where the oxide film is further likely to be formed. Then, after completion of 1000 cycles, with the method similar to the above-described method, anti-peeling performance of the plating layer and durability of the ground electrode were evaluated.

The results of the tests are listed in Table 3. The distance B was set to 0.05 mm for each sample, and a clearance was formed between the side face of the ground electrode side tip and the plating layer.

TABLE 3

DISTANCE B = 0.05 mm, HEATING TEMPERATURE = 950° C.

| SIZE A OF CLEARANCE (mm) | ANTI-PEELING PERFORMANCE OF PLATING LAYER | DURABILITY OF GROUND ELECTRODE |
|---|---|---|
| 0.1 | GOOD | GOOD |
| 0.2 | GOOD | POOR |

As shown in Table 3, it was confirmed that the sample with the size A of the clearance equal to or less than 0.1 mm can ensure excellent durability of the ground electrode although the sample was under an extremely strict condition where an oxide film is further likely to be formed. This is probably because penetration of oxygen or the like between the plating layer and the ground electrode was reduced extremely efficiently.

From the above-described test results, to further improve durability of the ground electrode, it is further preferred that the size A of the clearance be equal to or less than 0.1 mm.

Next, samples of the spark plugs with the groove portions having a width of 0.01 mm or 0.05 mm within the range (the range RA) and samples of the spark plugs without the groove portions at the plating layer were fabricated. The groove portions were disposed within the range RA, which is a range from the inner circumference end of the plating layer to a side away from the ground electrode side tip (maximum 0.4 mm). Heating temperature was changed to 1000° C. for each sample, and the above-described benchtop thermal cycle test was performed. Then, after completion of 1000 cycles, with the method similar to the above-described method, anti-peeling performance of the plating layer and durability of the ground electrode were evaluated. Changing the heating temperature to 1000° C. set the conditions where the plating layer is further likely to expand thermally greatly and the plating layer is extremely likely to contact the other end face of the ground electrode side tip.

The results of the tests are listed in Table 4. The size A of the clearance was set to 0.1 mm and the distance B was set to 0.05 mm for each sample, and a clearance was formed between the side face of the ground electrode side tip and the plating layer. Additionally, a width of the groove portion was changed by adjusting an output of a laser beam during welding of the ground electrode side tip to the ground electrode.

TABLE 4

SIZE A = 0.5 mm, DISTANCE B = 0.05 mm, HEATING TEMPERATURE = 1000° C.

| PRESENCE OF GROOVE PORTION (WIDTH OF GROOVE PORTION) | ANTI-PEELING PERFORMANCE OF PLATING LAYER | DURABILITY OF GROUND ELECTRODE |
|---|---|---|
| ABSENCE | POOR | GOOD |
| PRESENCE (0.01 mm) | GOOD | GOOD |
| PRESENCE (0.05 mm) | GOOD | GOOD |

As shown in Table 4, it was found that the sample with the groove portions disposed in the predetermined range of the plating layer achieved excellent durability of the plating layer although the sample was under an extremely severe condition. This is probably because thermal expansion of the plating layer to the groove portion side during heating reduces thermal expansion of the plating layer to the ground electrode side tip side.

From the above-described tests, in terms of further reliably preventing the peeling of the plating layer, it is more preferred that the plating layer include a groove portion disposed in a range of up to 0.4 mm from an inner circumference end, which forms the clearance with a part that includes a constituent material of the ground electrode side tip of the plating layer, to a direction separated from the ground electrode side tip along a perpendicular direction to a central axis of the ground electrode side tip.

Note that, if the width of the groove portion is set to more than 0.05 mm, oxygen or the like is likely to penetrate between the plating layer and the ground electrode through the groove portion. This may result in degradation of durability of the ground electrode. Accordingly, in case of disposing the groove portion, the width of the groove portion is preferably equal to or less than 0.05 mm. Further, to fully achieve the above-described efficiency of reduction in the peeling of the plating layer, it is preferred that the width of the groove portion be equal to or more than 0.01 mm.

Samples of the spark plugs where the distances B were variously changed were manufactured, and benchtop spark durability test was performed on each sample. The overview of the benchtop spark durability test is as follows. Each sample was mounted to a predetermined chamber, and the chamber was filled with a nitrogen atmosphere. The center electrode was employed as a negative electrode, a frequency of an applied voltage was set to 100 Hz (in short, in a proportion of 6000 times per minute), and a spark discharge was generated. After a lapse of 100 hours, the size of the spark discharge gap was measured after the test. Then, an increment relative to the size of the spark discharge gap before the test (gap increment) was calculated. Here, the sample with the gap increment of equal to or more than 0.2 mm was regarded to be inferior in wear resistance. Therefore, the sample was evaluated as "poor". Meanwhile, the sample with the gap increment of less than 0.2 mm was regarded to have excellent wear resistance, and therefore evaluated as "good".

The results of the tests are listed in Table 5. The size of the spark discharge gap before the test was set to 0.8 mm for each sample.

TABLE 5

| DISTANCE B (mm) | WEAR RESISTANCE |
|---|---|
| 0.05 | GOOD |
| 0.1 | GOOD |
| 0.2 | GOOD |
| 0.3 | POOR |

As shown in Table 5, it was found that the sample with the distance B of equal to or less than 0.2 mm exhibited excellent wear resistance. This was possibly caused by the following circumstances. The distance B was set to equal to or less than 0.2 mm, and the other end face of the ground electrode side tip and the surface of the plating layer were configured to form approximately a flat surface. Accordingly, spark discharge occurred not only at the other end face of the ground electrode side tip but also at the surface of the plating layer between the other end face and the center electrode. Additionally, overheating of the ground electrode side tip was prevented by reduction of the projection of the ground electrode side tip.

From the above-described test results, to further improve wear resistance against spark discharge, it is preferred that the distance B be equal to or less than 0.2 mm.

This disclosure is not limited to the above-described embodiment, but may be embodied, for example, as follows. Of course, applications and modifications other than those exemplified below are also possible.

Figure 8:
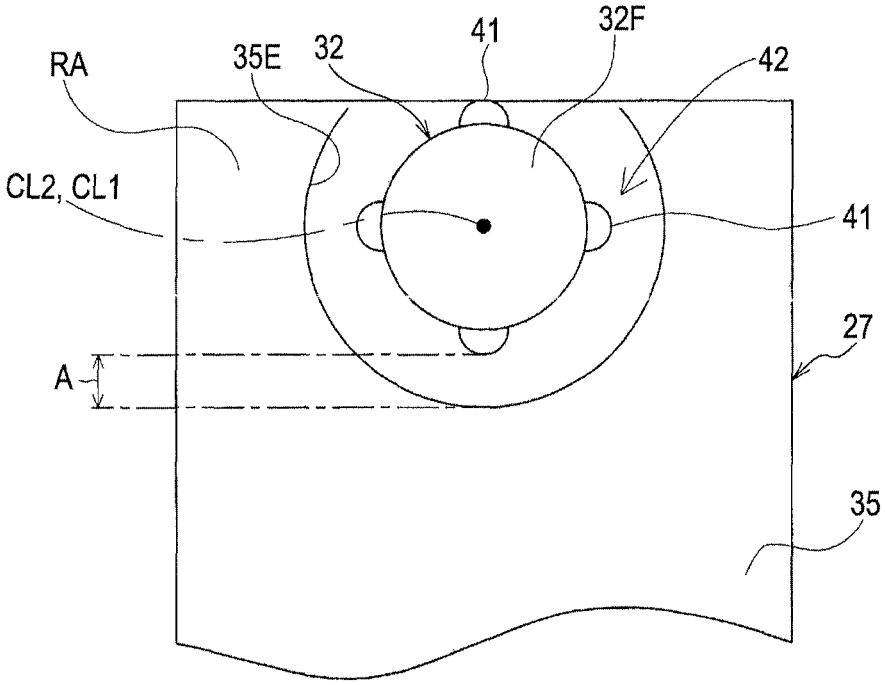
FIG. 8 is an enlarged top view showing a configuration of the fusion portion according to another embodiment.

(a) In the above-described embodiment, the fusion portion 39 is formed across the entire region of the outer circumference of the ground electrode side tip 32 in the circumferential direction. As shown in FIG. 8, a fusion portion 41 may be formed at a part of the outer circumference of the ground electrode side tip 32 in the circumferential direction, and the ground electrode side tip 32 may be welded to the ground electrode 27 with the fusion portion 41. In this case, a clearance 42 is formed between the side face of the ground electrode side tip 32 and the plating layer 35 and between the fusion portion 41 and the plating layer 35.

Figure 9:
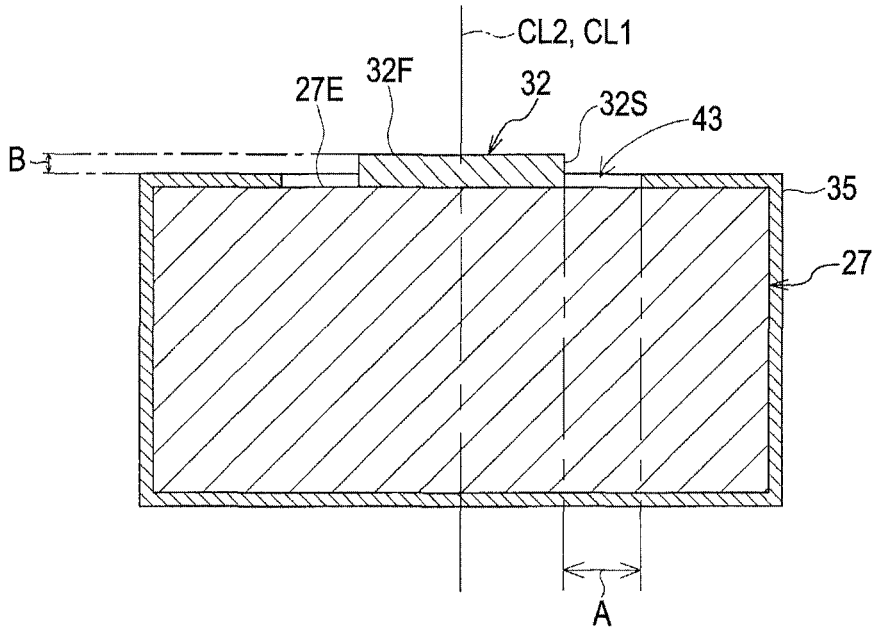
FIG. 9 is a sectional view showing a ground electrode side tip welded to the ground electrode according to another embodiment.

(b) In the above-described embodiment, the ground electrode side tip 32 is welded to the ground electrode 27 by laser welding. The ground electrode side tip 32 may be welded to the ground electrode 27 by resistance welding. In this case, as shown in FIG. 9 (note that in FIG. 9, the thickness of the plating layer 35 is depicted thicker than the actual thickness for convenience of illustration), the fusion portion hardly exists. Accordingly, a clearance 43 is formed between the side face of the ground electrode side tip 32 and the plating layer 35.

Figure 10:
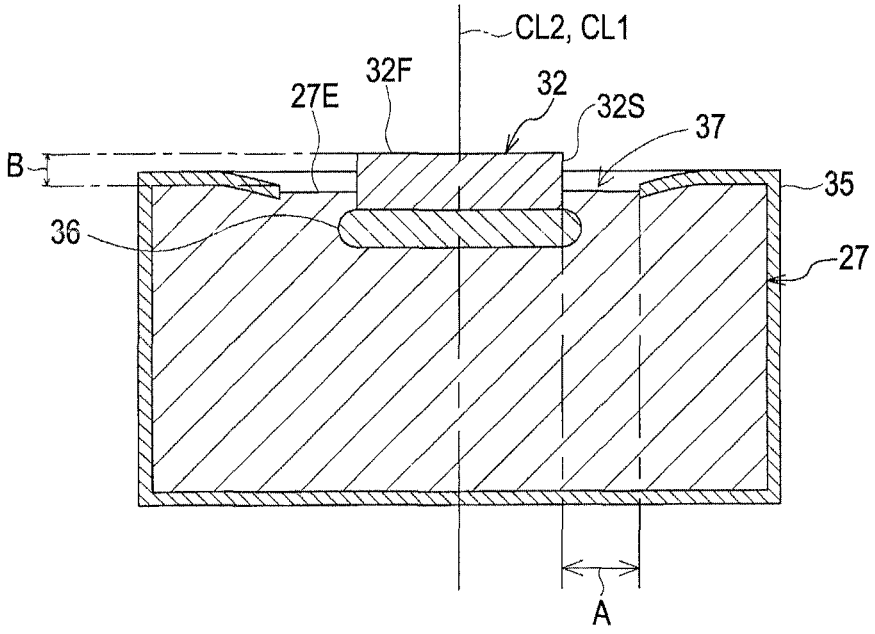
FIG. 10 is a sectional view showing the plating layer according to another embodiment.

(c) In the above-described embodiment, a part positioned at the clearance 37 side in the plating layer 35 is constituted such that the distance, which is from the surface of the plating layer 35 to the other end face of the ground electrode side tip 32 along the central axis CL2 is approximately constant in the entire region. In contrast to this, as shown in FIG. 10 (note that in FIG. 10, the thickness of the plating layer 35 is depicted thicker than the actual thickness for convenience of illustration), a part positioned at the clearance 37 side in the plating layer 35 may be constituted such that the distance, which is from the surface of the plating layer 35 to the other end face 32F of the ground electrode side tip 32 along the central axis CL2, gradually increases as the plating layer 35 approaches the ground electrode side tip 32 side. That is, the plating layer 35 may be constituted such that the surface of the plating layer 35 recedes from the other end face 32F of the ground electrode side tip 32 as the plating layer 35 approaches the ground electrode side tip 32. In this case, during heating (during thermal expansion), running up of the plating layer 35 onto the other end face 32F of the ground electrode side tip 32 can further be reliably prevented, thus the peeling of the plating layer 35 can further be reliably prevented.

The configuration where the surface of the plating layer 35 recedes from the other end face 32F as the surface of the plating layer 35 approaches the ground electrode side tip 32 can be achieved by a method such as the following. A surface in the ground electrode 27 where the ground electrode side tip 32 is to be welded is inclined toward the ground electrode side tip 32 side by a method such as cutting work, and then the plating layer 35 can be formed on the surface of the ground electrode 27. Alternatively, the plating layer 35 is formed on the surface of the ground electrode 27, and then the formed plating layer 35 is pressed.

(d) In the above-described embodiment, the plating layer 35 is formed of a metal whose main constituent is Ni. However, the plating layer 35 may be formed of a metal whose main constituent is a metal other than Ni. For example, the plating layer may be formed of a metal whose main constituent is zinc (Zn).

(e) In the above-described embodiment, the ground electrode side tip 32 is formed into a disk shape. However, the shape of the ground electrode side tip 32 is not limited thereto. For example, the ground electrode side tip may be formed into a prism shape (e.g. a rectangular parallelepiped shape).

(f) In the above-described embodiment, the groove portion 38 extends along a circumferential direction of the ground electrode side tip 32. However, the shape of the groove portion 38 is not limited thereto. For example, the groove portion may have a shape extending along the radial direction of the ground electrode side tip 32.

(g) In the above-described embodiment, the ground electrode side tip 32 is welded to the side face of the ground electrode 27 at the center electrode 5 side. A ground electrode tip may be welded to the front end surface of the ground electrode 27. Spark discharge may be performed between the other end face 32F of the ground electrode side tip 32 and the side face of the center electrode 5 (the center electrode side tip 31) approximately along the direction perpendicular to the axis CL1.

(h) In the above-described embodiment, the ground electrode 27 is formed of a single metal. The inner layer made of a material such as copper and copper alloy, which exhibits good thermal conductivity, is formed inside of the ground electrode 27 so that the ground electrode 27 is formed with a plurality of layers including an outer layer and an inner layer.

(i) In the above-described embodiment, the disclosure is applied to a case in which the ground electrode 27 is welded to the front end portion 26 of the metal shell 3. However, this disclosure can also be applied to a case in which its ground electrode is formed, through cutting operation, from a portion (or a portion of a front end metal shell welded to the metal shell in advance) of the metal shell (see, for example, JP 2006-236906 A).

(j) In the above-described embodiment, the tool engagement portion 19 has a hexagonal cross section. However, the shape of the tool engagement portion 19 is not limited thereto. For example, the tool engagement portion 19 may have a Bi-HEX (modified dodecagonal) shape [ISO22977:2005(E)] or the like.

The foregoing detailed description has been presented for the purposes of illustration and description. Many modifications and variations are possible in light of the above teaching. It is not intended to be exhaustive or to limit the subject matter described herein to the precise form disclosed. Although the subject matter has been described in language specific to structural features and/or methodological acts, it is to be understood that the subject matter defined in the appended claims is not necessarily limited to the specific features or acts described above. Rather, the specific features and acts described above are disclosed as example forms of implementing the claims appended hereto.

What is claimed is:

1. A spark plug comprising:

a tubular insulator having an axial hole penetrating in a direction of an axis;

a center electrode inserted into a tip end side of the axial hole;

a tubular metal shell disposed at an outer circumference of the insulator;

a ground electrode disposed at a front end portion of the metal shell; and a pillar body tip that includes one end face and another end face, the one end face being welded to the ground electrode, the other end face forming a gap with a front end portion of the center electrode, wherein the ground electrode includes a part where the tip is to be welded, a clearance formed between a plating layer and a part including a constituent material of the tip;

the ground electrode includes a surface where the plating layer is disposed, the plating layer covering the surface excluding a formation part of the clearance in the surface of the ground electrode; and the clearance has a size A that is equal to or more than 0.01 mm and equal to or less than 0.5 mm.

2. The spark plug according to claim 1, wherein the plating layer has a distance B from a surface of a part closest to the tip to the other end face of the tip along a central axis of the tip, the distance B being equal to or less than 0.2 mm.

3. The spark plug according to claim 1, wherein the clearance has the size A that is equal to or less than 0.2 mm.

4. The spark plug according to claim 1, wherein the clearance has the size A that is equal to or less than 0.1 mm.

5. The spark plug according to claim 1, wherein the plating layer includes a groove portion disposed in a range of up to 0.4 mm from the inner circumference end of the plating layer to a direction separated from the tip along a perpendicular direction to a central axis of the tip, the inner circumference end forming the clearance with a part that includes a constituent material of the tip in the plating layer.

6. The spark plug according to claim 1, wherein the plating layer has a part positioned at the clearance side that is constituted such that a distance along a central axis of the tip from a surface of the plating layer to the other end face of the tip gradually increases as the plating layer approaches the tip side.

* * * * *